US008074847B2

(12) United States Patent
Smith

(10) Patent No.: US 8,074,847 B2
(45) Date of Patent: Dec. 13, 2011

(54) PRESSURIZED PACKAGE

(75) Inventor: Scott Edward Smith, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 12/701,106

(22) Filed: Feb. 5, 2010

(65) Prior Publication Data

US 2010/0200612 A1 Aug. 12, 2010

Related U.S. Application Data

(63) Continuation of application No. 11/405,288, filed on Apr. 17, 2006, now abandoned.

(51) Int. Cl.
*B65D 83/00* (2006.01)

(52) U.S. Cl. ..... 222/402.1; 222/394; 222/95

(58) Field of Classification Search ..... 222/402.1, 222/402.11, 321.2, 394, 95, 402.12–402.19, 222/402.21, 321.1, 321.7–321.9
See application file for complete search history.

(56) References Cited

U.S. PATENT DOCUMENTS

| | | | | |
|---|---|---|---|---|
| 3,106,321 | A * | 10/1963 | Gorman | 222/402.24 |
| 3,217,936 | A | 11/1965 | Henry | |
| 3,225,967 | A | 12/1965 | Heimgartner | |
| 3,593,887 | A | 7/1971 | Morane | |
| 3,669,313 | A | 6/1972 | Marand et al. | |
| 3,791,551 | A | 2/1974 | Madeira | |
| 3,819,090 | A | 6/1974 | Birrell | |
| 3,991,915 | A | 11/1976 | Kinnavy | |
| 4,150,522 | A | 4/1979 | Burger | |
| 4,328,843 | A | 5/1982 | Fujii | |
| 4,383,399 | A | 5/1983 | Stoody | |
| 4,417,674 | A | 11/1983 | Giuffredi | |
| 4,730,752 | A | 3/1988 | Kimball et al. | |
| 4,838,457 | A | 6/1989 | Swahl et al. | |
| 4,958,757 | A | 9/1990 | Greenebaume, II | |
| 5,064,121 | A | 11/1991 | Bolduc | |
| 5,123,571 | A | 6/1992 | Rebeyrolle et al. | |
| 5,199,615 | A | 4/1993 | Downing et al. | |
| 5,265,765 | A | 11/1993 | Maier | |
| 5,615,803 | A | 4/1997 | Hatakeyama | |
| 5,695,096 | A | 12/1997 | Yquel | |
| 5,839,624 | A | 11/1998 | Parsons | |
| 6,230,943 | B1 | 5/2001 | Miyamoto et al. | |
| 6,253,970 | B1 | 7/2001 | Kohn et al. | |
| 6,343,722 | B1 * | 2/2002 | Di Giovanni | 222/402.1 |
| 6,360,477 | B1 | 3/2002 | Flashinski et al. | |
| 6,439,430 | B1 | 8/2002 | Gilroy et al. | |
| 6,527,150 | B2 | 3/2003 | Benoist | |
| 6,736,288 | B1 | 5/2004 | Green | |
| 6,868,994 | B2 | 3/2005 | Kawolics | |
| 2001/0025857 | A1 | 10/2001 | Baudin | |
| 2004/0084347 | A1 | 5/2004 | Albaum | |

(Continued)

FOREIGN PATENT DOCUMENTS

| | | |
|---|---|---|
| CH | 674 760 A5 | 7/1990 |

(Continued)

*Primary Examiner* — Kevin P Shaver
*Assistant Examiner* — Jonathan Wood
(74) *Attorney, Agent, or Firm* — Larry L. Huston; Leonard W. Lewis; Steven W. Miller

(57) ABSTRACT

A pressurized package for dispensing product there from through a valve. The valve is attached to the package by a valve cup. The valve cup is plastic, eliminating the need for metallic deformation to maintain pressurization of the container having propellant therein. This arrangement provides the benefit of less expensive package assembly.

10 Claims, 5 Drawing Sheets

U.S. PATENT DOCUMENTS

| | | | |
|---|---|---|---|
| 2004/0084480 | A1 | 5/2004 | Domoy et al. |
| 2005/0005995 | A1 | 1/2005 | Pericard |
| 2005/0155980 | A1 | 7/2005 | Neuhalfen |
| 2005/0244307 | A1 | 11/2005 | Gygax et al. |

FOREIGN PATENT DOCUMENTS

| | | | |
|---|---|---|---|
| EP | 0 926 070 | A1 | 6/1999 |
| EP | 1 547 937 | A | 6/2005 |
| FR | 1 568 809 | A | 5/1969 |
| GB | 763035 | A | 12/1956 |
| GB | 966468 | | 8/1964 |
| GB | 1 242 613 | A | 8/1971 |
| GB | 1 255 022 | A | 11/1971 |
| GB | 1 269 801 | A | 4/1972 |
| WO | WO 98/43882 | A | 10/1998 |
| WO | WO 02/26392 | A1 | 4/2002 |

* cited by examiner

PRESSURIZED PACKAGE

CROSS-REFERENCE TO RELATED APPLICATIONS

This application is a continuation of U.S. application Ser. No. 11/405,288, filed Apr. 17, 2006 now abandoned.

FIELD OF THE INVENTION

The present invention relates to packages for containing a product therein, and more particularly to pressurizable packages for dispensing products therefrom.

BACKGROUND OF THE INVENTION

Packages for containing a product are well known in the art. Such packages may have a dispensing nozzle or dispensing orifice to allow the product to be dispensed from the package. The dispensing nozzle or dispensing orifice may be disposed near the top of the package, although other configurations and locations are also known in the art.

Motive force for dispensing the product from the package include gaseous propellants, pumps (both manual and electric), gravity feed systems, elastic bladders, etc. Packages using propellants are particularly popular, because such packages allow for continuous dispensing at the touch of a button. Likewise, elastic bags may be filled with product to a pressure greater than atmospheric. In either case, product dispensing occurs due to the pressure differential between the product and the ambient.

Products to be contained in and dispensed from the package include almost any gaseous, liquid, or farinaceous material, compatible with the package materials and suitable for the intended use. Nonlimiting, exemplary products include, but are not limited to, perfume, medicaments, air treatments, such as air fresheners, insect repellents, cosmetics, cleaners, etc.

Furthermore, it may be desirable to have two or more products in the same packages. The products may be separated until combined during the dispensing process at the point of use. For example, enzymes and bleach may be separated until the point of use, to prevent undue interaction and loss of efficacy during packaging.

It may be desirable to allow the product to be visible prior to dispensing from the package. For example, this allows the user to see how much product is left before depletion and/or may simply be aesthetically pleasing.

However, packaging which allows viewing of the product before dispensing presents challenges. As the product is depleted flexible packaging may assume aesthetically undesirable configurations, leading to a less preferred package. The challenge is compounded for packaging holding plural, but separated, products. The search continues for packages which are functional, aesthetically pleasing and/or economical to manufacture

SUMMARY OF THE INVENTION

The invention comprises a pressurized package for dispensing contents therefrom through a valve. The valve is attached to the container using a plastic valve cup. This arrangement may eliminate the need for crimping, etc, as may be necessary to hold pressure in a package having a metal valve cup. All patents and other documents cited herein are incorporated herein by reference.

DETAILED DESCRIPTION OF THE INVENTION

Figure 1:
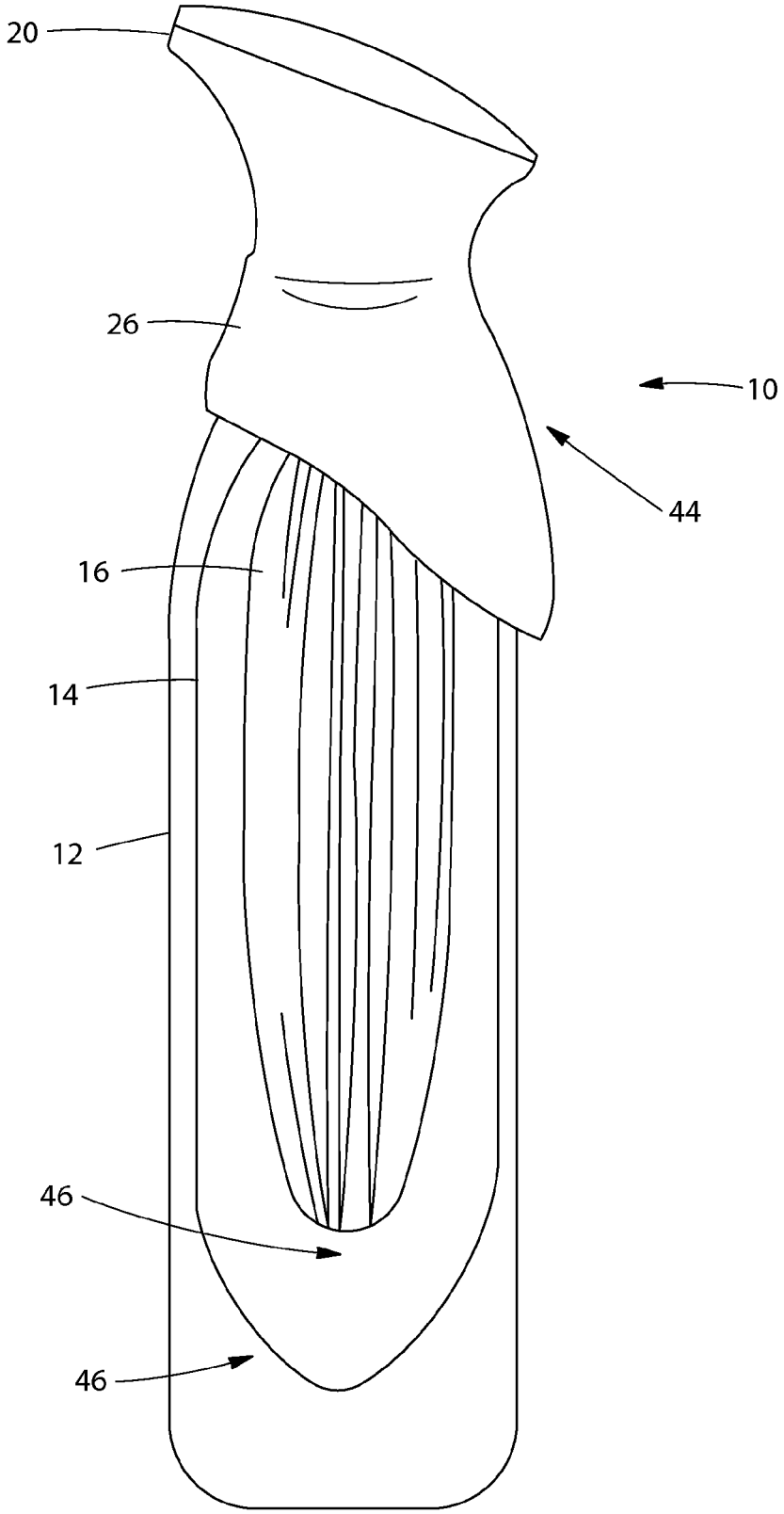
FIG. 1 is a vertical elevational view of a package according to the present invention.

Referring to FIG. 1, the invention is a package 10 comprising plural containers. One or more containers may be disposed inside each other to yield an outer container 12 having one or more containers therein.

If the package 10 has two containers, this arrangement yields a package 10 having an outer container 12 and an inner container 16 disposed therein. If the package 10 has three containers 12, 14, 16, this arrangement yields a package 10 having an outer container 12 with a central container 14 disposed therein and an inner container 16 disposed in the central container 14. In such an arrangement the central container 14 is disposed between the outer container 12 and the inner container 16.

The plural containers 12, 14, 16 keep different materials contained therein substantially isolated until the materials are dispensed at the point of use. During or after the dispensing process the materials may be mixed. The materials may include one or more products intended jointly or separately for one or more end uses, one or more propellants, air, water, etc.

The product(s) may comprise any dispensable substance and includes gaseous, liquid, and farinaceous particulate materials, which may be dispensed using the package 10 described and claimed herein. It is simply necessary that the product viscosity be low enough for the product to be dispensed from a package 10 having the desired pressure and dispensing characteristics.

The containers 12, 14, 16, may have a common discharge. The discharge may be a dispensing orifice, drain, aperture or other dispensing device, as is known in the art. A nozzle will be discussed for exemplary and illustrative purposes. The nozzle 20 may be pressed or otherwise displaced from its normally closed position to provide a flow path for material disposed in the container to the environment. For example, one suitable type of nozzle 20 is a normally closed spray orifice. Alternatively a trigger, cam, etc. may be utilized to open the flow path for product disposed inside one container to be dispensed to the environment. Suitable nozzle 20s are disclosed in U.S. Pat. No. 3,690,515 issued to Ewald, U.S. Pat. No. 4,940,170 issued to Popp-Ginsbach, U.S. Pat. No. 4,964,539 issued to Mueller, U.S. Pat. No. 5,497,911 issued to Ellion et al. and U.S. Pat. No. 5,839,623 issued to Losenno et al.

If desired, one or more of the containers may have a dip tube. The dip tube may be used to transport product from the bottom of that container to the discharge.

Examining the package 10 in more detail, one or more of the containers 12, 14, 16 may be translucent or clear. By translucent, it is meant that light can pass through the wall of the container, sufficient for a viewer to discern the presence of product therein. By clear it is meant that light can pass through the wall of the container and images discerned on the other side of the wall. In either case, having a clear container 12, 14, 16, or a translucent container 12, 14, 16, a product or container 14, 16 therein is visible from outside the package 10.

In one embodiment according to the invention the outer container 12 is clear or translucent. This allows a central container 14 or inner container 16 therein to be viewed from outside the package 10. Furthermore, any material disposed in the outer container 12 is likewise viewable from outside the package 10.

The outer container 12 may be rigid. By rigid, it is meant that the container 12, 14, 16 does not substantially change shape or size in response to normal usage forces or depletion of the contents of the package 10. A rigid outer container 12 allows the package 10 to be conveniently shipped, stored, displayed, placed on a tabletop, etc. Furthermore, a rigid outer container 12 provides protection in the event that the package 10 is dropped, or otherwise disturbed. Suitable materials for the outer container 12 include plastic, glass, combinations thereof, etc. of any wall thickness suitable for the intended pressurization.

The inner container 16 and/or central container 14, if present, may likewise be clear or translucent. A clear or translucent central container 14 allows product therein, as well as any inner container 16 to be viewed from outside the package 10. Similarly, a clear or translucent inner container 16 allows product therein to be viewed from outside the package 10. Of course, it will be apparent that a dip tube, if present, would be visible inside any clear or translucent container 12, 14, 16, provided that any containers 12, 14 outside of that container 14, 16 are likewise clear or translucent. The dip tube, valve assembly, and/or valve cup 24, if present, may also be clear/translucent.

Materials suitable for use with the package 10 of the present invention include, but are not limited to: polypropylene (PP), polyethylene (PE), polyethylene napthylate (PEN), polycarbonate (PC), polyamides (PA) and/or polyethylene terephthalate (PET), polyvinylchloride (PVC); and polystyrene (PS).

A transparent container 12, 14, 16 according to the invention may have a transmittance of more than 25%, more than 30%, more than 40%, or more than 50% in the visible part of the spectrum, approximately 410-800 nm. Alternatively, absorbency of container 12, 14, 16 may be measured as less than 0.6 or by having transmittance greater than 25% wherein percent transmittance equals: (1/(10 exp (absorbency)))× 100%. For purposes of the invention, as long as one wavelength in the visible light range has greater than 25% transmittance, the respective container 12, 14, 16 is considered to be transparent/translucent.

By clear and translucent, it is meant to include inner containers 16, central containers 14 and/or outer containers 12 which are entirely clear or translucent. The terms clear and translucent also include inner containers 16, central containers 14 and/or outer containers 12 which have clear and/or translucent regions. The clear or translucent regions may be sections of these containers, such as a top half, a bottom segment, may be windows or portals, may be striped with alternating opaque regions, etc.

The inner container 16 and/or central container 14 may be rigid or flexible. By flexible it is meant that the container 12, 14, 16 changes shape or size during ordinary use, either due to forces exerted by the user or depletion of the contents. For example, a flexible container 12, 14, 16 may assume a lesser volume due to contents being dispensed therefrom. If a flexible container 12, 14, 16 is desired, suitable materials include elastomers, natural or synthetic rubber, polyolefins, polyesters, nylons, etc., or mixtures/combinations thereof, with the understanding that transparency/translucency will be provided at least in part, as desired.

Figure 2:
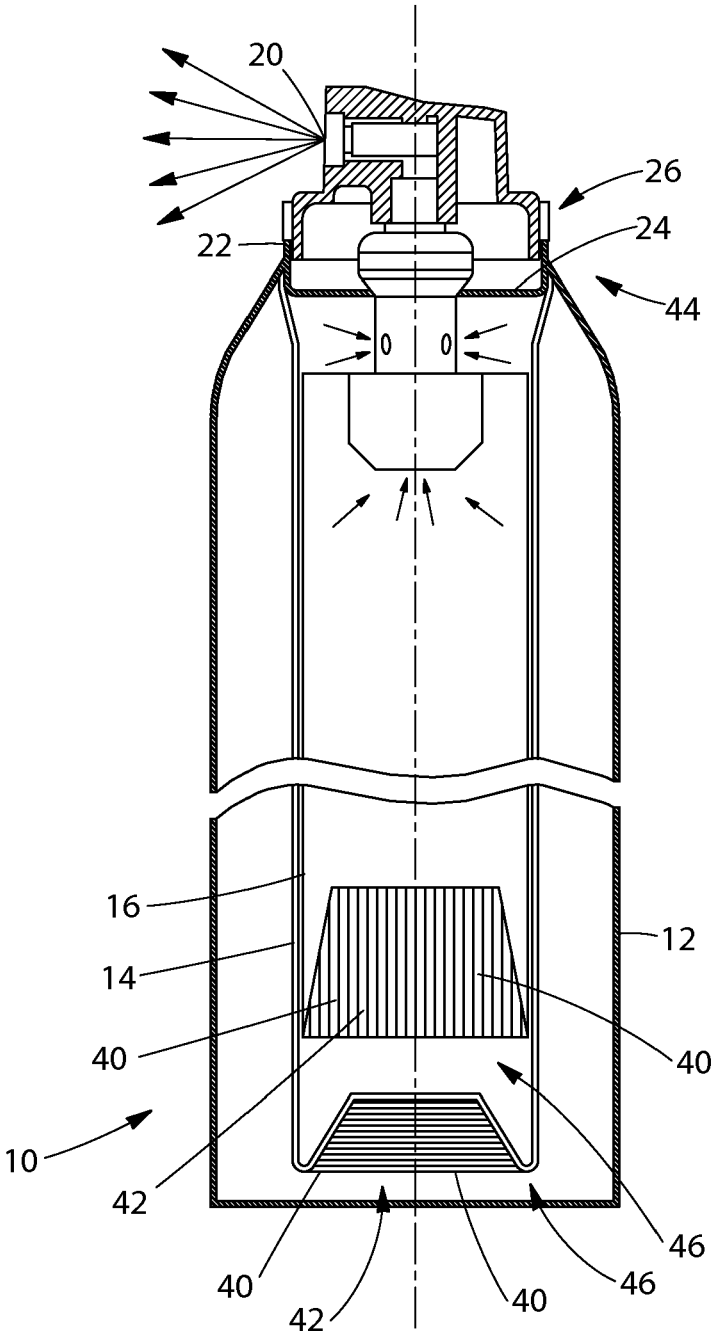
FIG. 2 is a vertical sectional view of a variant embodiment of a package similar to that shown in FIG. 1 and having an inner container with an inversion having longitudinal hinge lines and a central container with an inversion having circumferential hinge lines, the inversions having equally spaced hinge lines on the right-hand sides of the inversions and unequally spaced hinge lines on the left-hand sides of the inversions.

Referring to FIG. 2, the inner container 16, outer container 12 and central container 14, if present, may have a common discharge. The common discharge may include a flange 22, which is juxtaposed with an opening. The opening may be a generally planar opening and disposed on the outer container 12, or the opening may be nonplanar and primarily disposed on the inner container 16 and/or central container 14.

Product may be disposed or inserted into the inner container 16, central container 14, and/or outer container 12 using a positive displacement system. One suitable positive displacement system is a volumetric piston. The volumetric piston has a linear displacement. The linear displacement inserts the product from a chamber, displacing the product from that chamber under pressure, into the desired container 14, 16, as is known in the art.

The inner container 16 may have a flow path which is coaxially disposed, in whole or in part, within the flow path of the flow path of the central container 14. The coaxial flow path may extend from the flange 22 to a point juxtaposed with a swirl chamber and comprise a conduit extending from each respective container. The outer conduit may completely or partially circumscribe the inner conduit along all or part of a common length.

The swirl chamber is a region disposed upstream of the nozzle 20. The swirl chamber may have a volume sufficient to allow intermixing of materials from the inner and central containers 14. Materials in the swirl chamber may mix and then exit through the nozzle 20 with a circumferential velocity component.

The discussion below refers to a package 10 having a valve cup 24 used in conjunction with the outer container 12. However, the invention is not so limited. The valve cup 24 may be used in conjunction with the inner container 16 or central container 14. The valve cup 24 may be used to secure a valve assembly to the outer container 12.

A valve assembly may include a movable stem or plug which opens a flow path for dispensing product from the corresponding container. Typically, metal valve cups 24 are used for pressurized packages 10 and plastic valve cups 24 are used for packages 10 which are not pressurized. However, a metal valve cup 24 is more expensive than a comparable plastic valve cup 24 and requires plastic deformation of the metal flange 22 for attachment to the outer container 12. This process requires specialized assembly machinery and may require undue assembly time and stress on the neck 26 of the outer container 12.

If a plastic valve cup 24 is utilized, the assembly procedure can be simplified. The valve cup 24 can be inserted into or outside of the neck 26 of the outer container 12. The valve cup 24 may be joined to the container neck 26 in any suitable fluid tight or vapor tight manner, sufficient to withstand internal or external pressurization of the container. A press fit, interference fit, clearance fit may be utilized for joining the neck 26 and valve cup 24. Joining may also be accomplished by friction welding, solvent welding, high frequency welding, adhesive, or a combination thereof. If desired, in intermediate material or component may be disposed between the valve cup 24 and neck 26, so long as such material or component provides an adequate seal.

Joining may also be accomplished by having protuberances on one of the neck 26 and valve cup 24, to provide a snap fit for holding these components together. In one embodiment, the protuberances may comprise plural flanges 22 disposed in series on the inside surface or outside surface of the container neck 26, valve or a combination thereof. In one embodiment, one or more of the flanges 22 may comprise an annular ring. Plural flanges 22, such as annular rings, may be disposed in series.

The neck 26 of the container may be of any suitable size, geometry shape and/or cross-section. Thus, while a round cross section is shown the invention is not so limited. The neck 26 may be parallel to the major axis of the package 10, perpendicular thereto, or at any angle therebetween. Further the neck 26 may be concentric or eccentric with respect to the major axis of the package 10. The neck 26 has an opening dimension 32. The opening dimension 32 extends from the center of the package 10 to the center of the wall forming the neck 26.

Figure 6:
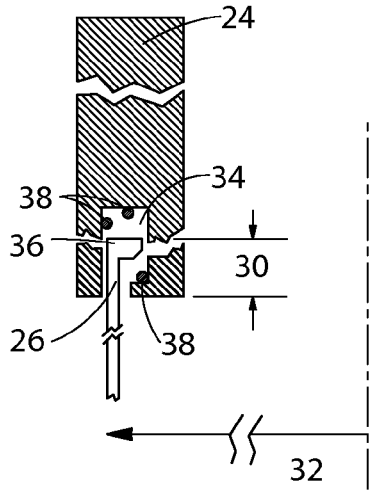
FIG. 6 is an enlarged fragmentary instantaneous sectional schematic view of an exemplary attachment for the valve cup according to the present invention and having an annular channel in the valve cup.

Referring to FIG. 6, the container may further have a joining length 30. The joining length 30, is the distance, which may be taken parallel to the neck 26, over which the neck 26 and valve cup 24 may be joined together to form a seal. In one embodiment, the neck 26 may comprise a protrusion 36 and the valve cup 24 may comprise a channel 34 for receiving such protrusion 36.

Figure 7:
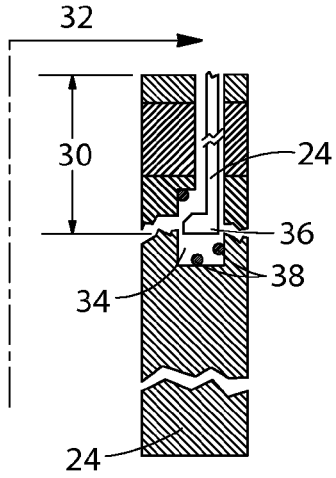
FIG. 7 is an enlarged fragmentary instantaneous sectional schematic view of an exemplary attachment for the valve cup according to the present invention and having an annular channel in the container neck.

Referring to FIG. 7, alternatively, the neck 26 may comprise the channel 34 and the valve cup 24 may comprise the protrusion 36 for being received in the channel 34. In either embodiment, the length over which the protrusion 36 is received in the channel 34 may correspond to the joining length 30. While FIG. 6 shows a particular arrangement of the inner and outer walls of the valve cup 24, channel 34 and protrusion 36, the invention is not so limited. This geometry may be transposed, so that it is inverted with respect to the major axis of the package 10.

The joining length 30 may be dependent upon the opening dimension 32. If the neck 26 is not circular, the opening dimension 32 is taken as the largest opening dimension 32 in that neck 26 of the package 10. To provide for adequate sealing against the internal and external pressurization of the containers 12, 14, 16, the package 10 may have a ratio of joining length 30 to opening dimension 32 of at least 1, 1.25, 1.5, 1.75, 2 or 2.5.

This arrangement provides the benefit, when used with a plastic container, and/or plastic valve cup 24 that a less total material may be utilized. For example, utilizing the current system of the prior art required additional material to form the crimp. Since the crimping process utilized a metal outer container 12, forming may be difficult. However, when utilizing the plastic container and/or plastic valve cup 24 of the present invention, the above cited ratios can be advantageous.

If desired, a gasket 38 may be disposed in the channel 34. The gasket 38 may be attached to the inside surface of the channel 34 or to the inside or outside of the protrusion 36 to be received in the channel 34. The gasket 38 may comprise any soft material, such as rubber, PET, polyethylene, urethane, etc. suitable for sealing against the desired pressurization. Of course, plural gaskets 38 may be utilized in series, and disposed on any combination of surfaces of the protrusion 36 and channel 34.

If desired, the gasket(s) 38 may be integral with the plastic valve cup 24, or the plastic neck 26 of the container. The gasket(s) 38 may be molded into the valve cup 24 or neck 26 as part of the manufacturing process. Alternatively, the valve cup 24 and/or and the neck 26 of the container may be made of a soft, pliable material obviating the need for a gasket 38.

In yet another embodiment, the inner container 16, or central container 14, if present, may provide the gasket 38, or obviate the need therefor. Such an arrangement may utilize an inner container 16 or central container 14 if present, which is pliable. By pliable it is meant that the material of that container 14, 16 can conform to the shape and surface of the outer container 12. If desired, the inner container 16 or central container 14 may be sealed to the valve cup 24, a valve housing, the dip tube or to the neck 26 of the outer container 12.

Figure 3:
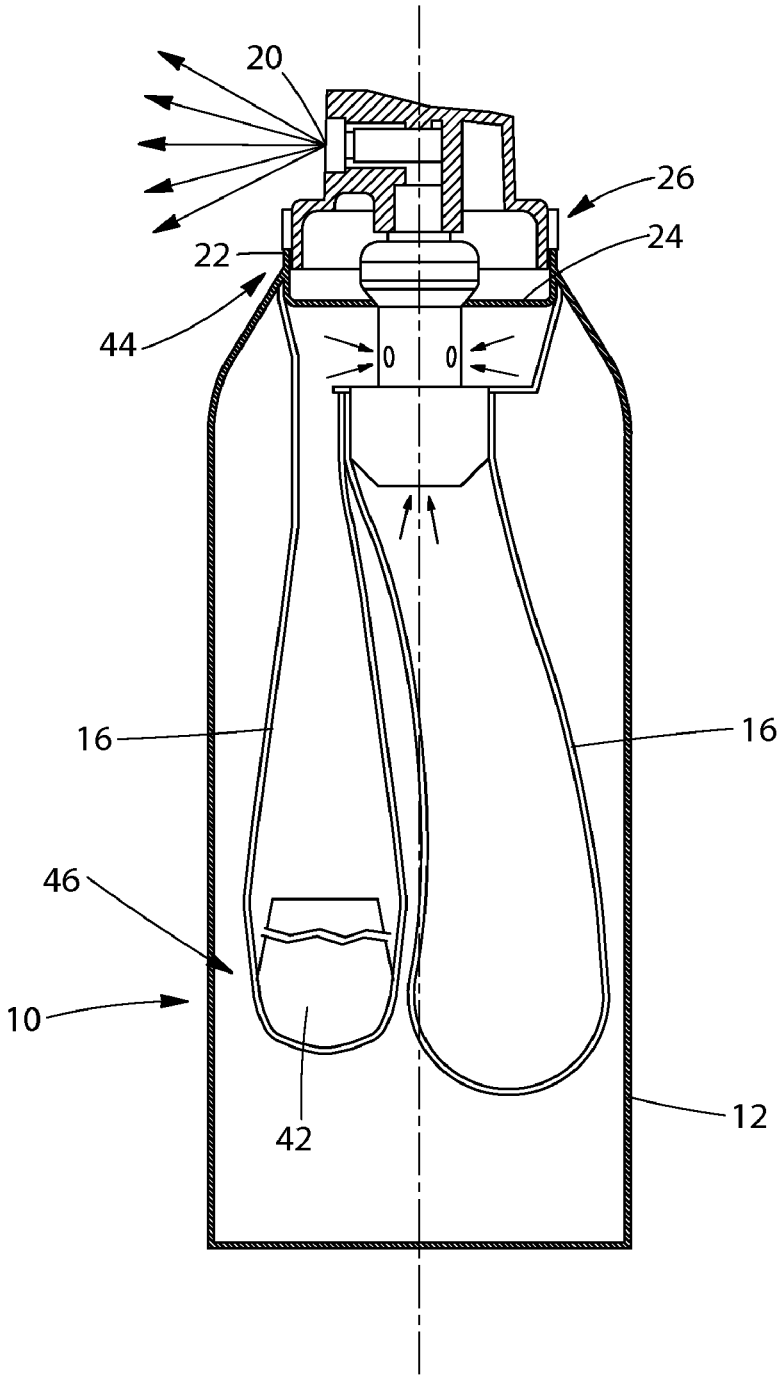
FIG. 3 is a vertical sectional view of an alternative embodiment having two inner containers disposed in parallel, one inner container having an asymmetrical inversion.

Referring to FIG. 3, if desired, plural inner containers 16 may be disposed in parallel. This arrangement allows generally equivalent volumes, and therefore generally equivalent amounts of materials to be utilized and co-dispensed. However, the plural inner containers 16 disposed in parallel may be of the same or different shape, volume, position within the outer container 12, color, transparency/translucency/opacity, flow rate, and contain the same or different materials and/or propellant Likewise the inner container 16 and central container 14 may be of the same or different shape, color, transparency/translucency/opacity, flow rate, and contain the same or different materials and/or propellant.

Of course, while two inner containers 16 are shown for illustrative purposes, the invention is not so limited. Three or more inner containers 16 may be utilized, as desired. Furthermore, one or more of the inner containers 16 disposed parallel with other inner containers 16 may be disposed inside a central container 14. Such an arrangement yields a compound system of one or more central containers 14 disposed in parallel with other central containers 14 and each having one or more inner containers 16 therein.

If plural inner containers 16 are disposed in parallel, the inner containers 16 may discharge into a common flow path. The flow path may be annular, as shown, or may be an inverted "T" or "Y" having one leg and two branches in fluid communication with each other. Each branch of the flow path is in fluid communication with one of the inner containers 16. The leg of the flow path is in fluid communication with the swirl chamber or another downstream region of the flow path.

Figure 4:
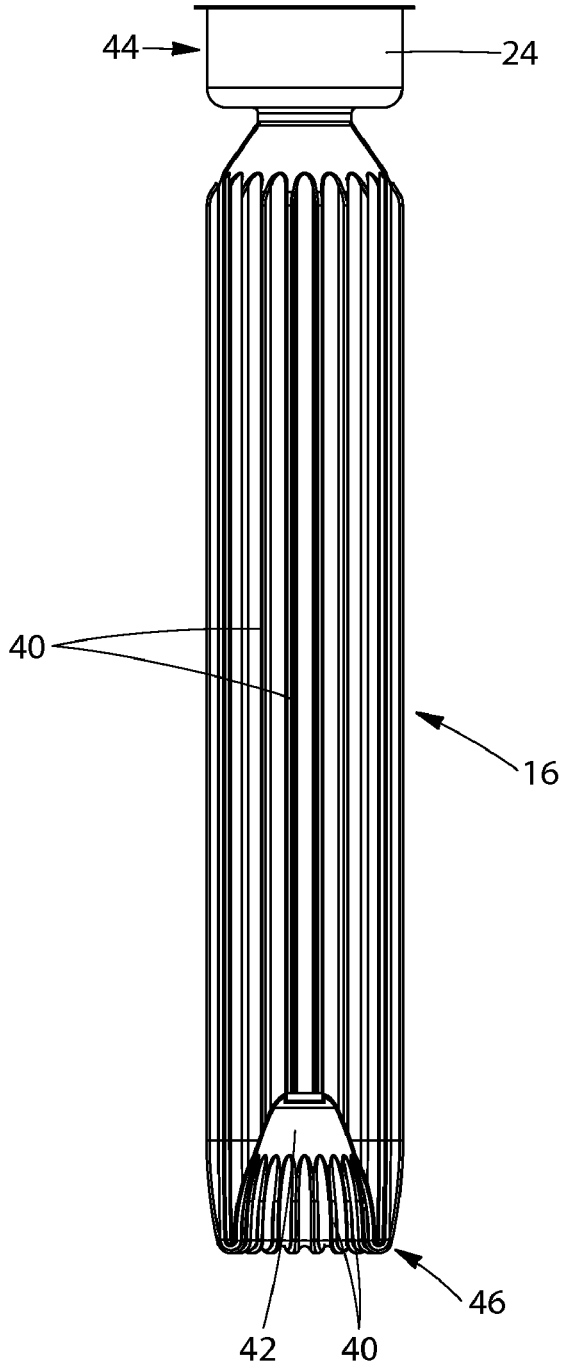
FIG. 4 is a side elevational view of an exemplary inner container or central container, having weakened regions.

Referring to FIG. 4, the inner container 16, and/or central container 14 may have weakened regions 40, which provide for preferential collapse of that container upon depletion of its contents. The weakened regions 40 may comprise regions of the container having a lesser/greater wall thickness, hinge lines, different materials having a lesser/greater stiffness and/or regions having a geometry which promotes the desired collapse. Such preferential collapse helps to obtain complete depletion of the contents of that container, and also can provide an aesthetically desirable appearance as the volume of that container shrinks.

The weakened regions 40 may comprise ribs, which act as hinge lines. The ribs may be generally longitudinally oriented, and disposed substantially parallel to the major axis of the package 10. This arrangement allows the diameter or other cross-sectional area of the inner container 16 and/or central container 14 to diminish as material is dispensed therefrom. Alternatively, the ribs/hinge lines may be oriented generally parallel to the cross-section of the container and a generally perpendicular to the major axis of the package 10. Alternatively, the ribs/hinge lines may be oriented on a diagonal. Of course combination of the foregoing geometries may be utilized as well.

Of course, the weakened regions 40 may be of plural orientations, extending in different directions. The weakened regions 40 may be equally or unequally circumferentially spaced around the container, and of the same or different weakness, size, longitudinal position, radial position, circumferential position, etc. Any configuration which provides for the desired collapse of the container may be suitable.

Figure 5A:
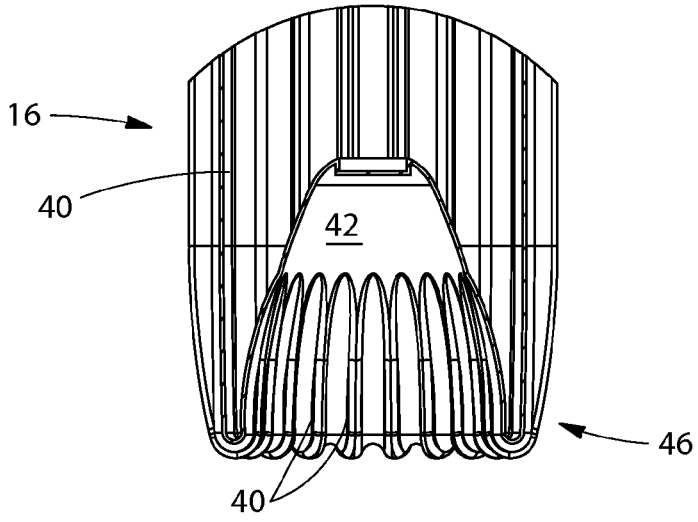
FIG. 5A is an enlarged fragmentary view of the distal end of the container of FIG. 4.
Figure 5B:
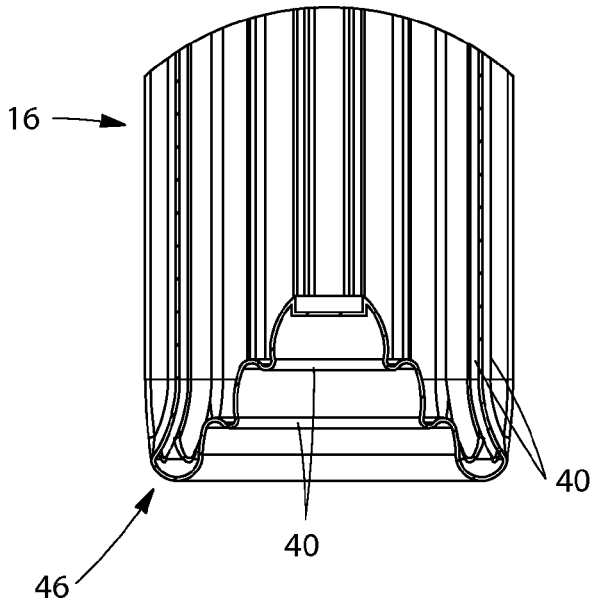
FIG. 5B is a fragmentary view of an alternative embodiment of a distal end of a container.

Referring to FIGS. 5A-5B, the inner container 16 and/or central container 14, if present, may define a major axis. The major axis is the direction, generally longitudinally oriented, along at the major dimension of the inner container 16, central container 14, outer container 12, or package 10. The inner container 16, central container 14, and/or outer container 12, may each define a proximal end 44 juxtaposed with the discharge and a distal end 46 remote therefrom.

The distal end 46 of the inner container 16 and/or central container 14, maybe inverted upon itself to provide an inversion 42. The inversion 42 reentrantly extends back towards the proximal end 44 of the respective container. The inversion 42 may be of generally lesser stiffness, particularly in the direction parallel the major axis, than the balance of that container 14, 16.

In another embodiment, the central container 14 and/or inner container 16 may be telescoping upon pressurization and/or filling. This provides expansion of that container 14, 16 in the longitudinal directions, as desired.

When material is disposed in a container having an inversion 42, the inversion 42 may expand away from the proximal end 44, parallel to the major axis. After expanding parallel to the major axis, the container may expand radially relative to the major axis. Upon removal of material therefrom, the container may collapse in the opposite order. Such expansion allows material with sufficient barrier properties to be utilized for the inner container 16, and or central container 14 and expansion/collapse of such container to occur upon insertion and removal of material therefrom, respectively.

This arrangement may provide the benefit that the distal end 46 of the inner container 16, or central container 14, if present, may contact the inner surface of the outer container 12. Such contact may occur at the distal end 46 of the outer container 12, the periphery (taken in the circumferential direction), or both. Such contact provides the benefit that if the package 10 is dropped, dynamic load is transferred from the outer container 12 through the contact to the inner and/or central container(s) 14, 16. This may reduce the chance of accidental rupture of the package 10 upon dropping.

If desired, the inner container 16 and/or central container 14 may be stiffer or otherwise more resistant to pressure at the proximal end 44 of that container 14, 16. This provides the benefit that a more uniform collapse of that container 14, 16 may occur as contents are dispensed therefrom. Such increased resistance to pressure, including external pressure may be accomplished by having an stiffer material, increased section modulus, increased wall thickness, etc. The increased resistance to collapse may be provided as a gradient, increasing as the proximal end 44 of that container 14, 16 is approached or as one or more step functions.

Referring back to FIG. 1, the outer container 12 and/or central container 14 may contain a propellant. The propellant may be used to dispense or otherwise discharge contents from one or more central containers 14 and inner containers 16. Suitable propellants include compressible propellants, including but not limited to nitrogen, carbon dioxide, air, nitrous oxide, argon etc. and having the benefit of being inert. Suitable propellants include condensable propellants, including but not limited to fluorocarbons, hydrocarbons, hydrofluorocarbons, etc. and having the benefit of constant pressure during dispensing.

If a condensable propellant is desired, one may apply a vacuum to the volume of the outer container 12. This vacuum minimizes the pressure from the condensable propellant, preventing the pressure from becoming too great during a use of the package 10.

If a condensable or compressible propellant is desired, the propellant may be disposed in the container as a solid state of matter, such as a capsule, granules etc. The solid may rupture upon dispensing of material from the package 10, due to the decrease of the pressure which occurs during dispensing.

Additionally or alternatively, the propellant may sublimate to provide the desired pressure in the outer container 12. Illustrative propellants include dry ice and acid/base combinations which generate gas. Generally cryogenic filling of the propellant may be utilized. If cryogenic filling is desired, the bottom of the respective container 12, 14, 16 may be reinforced, as necessary. If desired, the cryogenic propellant may be contained in a cup, for aesthetic purposes.

The package 10 may be charged with product as follows, although one of skill will recognize there is flexibility in the order that the illustrative steps are performed. First, the outer container 12 is provided. The outer container 12 may be filled with propellant at atmospheric pressure. The central container 14, if desired, is inserted in the outer container 12. The central container 14 is joined to the outer container 12 in fluid tight relationship, sufficient to withstand the expected pressurization of the package 10 prior to dispensing and during storage, shipment and handling.

A charge of product to be dispensed, and/or propellant, may then be inserted into the central container 14. The charge may be inserted into the central container 14 under pressure, causing it to expand. Expansion of the central container 14 decreases the available volume between the central container 14 and the outer container 12. Such decrease in the available volume pressurizes in the propellant within the outer container 12. The propellant may be held at, above or even below atmospheric pressure. Such pressurization of the propellant allows it to be useful for dispensing product from the central container 14. This operation allows for filling of the containers without the necessity of a bung hole, as is common in the art.

If desired, this process may be repeated for the inner container 16. Of course, one will recognize that product and/or propellant may be contained in any viable combination of the inner container 16, outer container 12 and the central container 14. Thus, the outer container 12 may contain the product and inner container 16 and/or central container 14 may contain product and/or propellant. Conversely, the central container 14 may contain the product and the inner and/or outer containers 12 may contain product and/or propellant.

While, a round cross-section package 10 having a generally vertically oriented major axis is illustrated, the invention is not so limited. The package 10 may be horizontally oriented, of any desired cross-section or orientation and size. The cross section may be constant or variable. The size and geometry must simply be suitable for the intended use of the material contained in the package 10. Likewise, the illustrated package 10 has the dispensing opening juxtaposed with the top of the package 10. Again, the invention is not so limited. The dispensing opening may be juxtaposed with the bottom of the package 10, as, for example, would be convenient for a gravity drain system or may be disposed at any intermediate position.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An internally pressurized package for dispensing a material therefrom, said package having a major axis defining an axial direction, said package comprising:

a container for containing a material and having a plastic neck, said neck having a round cross section with a radius;

a discharge for dispensing material from said package through a valve, said discharge comprising an opening and a plastic valve cup disposed in said opening intermediate said container and said valve, said valve cup being joined to said container in fluid tight or vapor tight relationship at said neck over a joining length, wherein one of said valve cup and said neck has a channel, said channel having two walls generally parallel to the axial direction and defining an annular channel therebetween, and the other of said valve cup and said neck having at least a portion thereof axially received in said annular channel, said joining length being taken generally along the major dimension of said neck as the overlap in the axial direction between said portion and said channel, whereby said joining length divided by said radius defines a ratio of at least 1.

2. A package according to claim 1 wherein said valve cup is joined to said neck of said container by a weld selected from the group consisting of a solvent weld, a friction weld, a high frequency weld and combinations thereof.

3. A package according to claim 1 wherein said valve cup is joined to said neck of said container by a snap fit.

4. A package according to claim 1 wherein said ratio is at least 1.5.

5. A package according to claim 4 wherein said ratio is at least 1.75.

6. A package according to claim 5 wherein said ratio is at least 2.

7. A package according to claim 1 wherein said valve cup has the channel and said neck has the portion received in said channel.

8. A package according to according to claim 7 wherein each component of said valve comprises plastic.

9. A package according to claim 7 further comprising a gasket, said gasket being disposed in said channel for sealing said portion.

10. A package according to claim 9 wherein said gasket is integral with one of said channel and said portion.

* * * * *